US005827636A

United States Patent [19]

Buongiorne et al.

[11] Patent Number: 5,827,636

[45] Date of Patent: Oct. 27, 1998

[54] PHOTOGRAPHIC REVERSAL PROCESS PREBLEACH CONCENTRATE

[75] Inventors: Jean Marie Buongiorne, Brockport; Michael John Haight, Rochester, both of N.Y.

[73] Assignee: Eastman Kodak Company, Rochester, N.Y.

[21] Appl. No.: 938,164

[22] Filed: Sep. 26, 1997

Related U.S. Application Data

[62] Division of Ser. No. 670,307, Jun. 27, 1996.

[51] Int. Cl.[6] ..... G03C 5/42; G03C 5/44

[52] U.S. Cl. ..... 430/461; 430/449; 430/455; 430/462; 430/463

[58] Field of Search ..... 430/393, 461, 430/455, 449, 462, 463

[56] References Cited

U.S. PATENT DOCUMENTS 4,786,583 11/1988 Schwartz ..... 430/372
4,921,779 5/1990 Cullinan et al. ..... 430/379
4,960,682 10/1990 Cullinan et al. ..... 430/393
4,975,356 12/1990 Cullinan et al. ..... 430/427
5,037,725 8/1991 Cullinan et al. ..... 430/372
5,523,195 6/1996 Darmon et al. ..... 430/393
5,552,264 9/1996 Cullinan et al. ..... 430/372
5,578,427 11/1996 Cullinan et al. ..... 430/379

*Primary Examiner*—Geraldine Letscher
*Attorney, Agent, or Firm*—J. Lanny Tucker

[57] ABSTRACT

A conditioning or bleach accelerating solution is prepared by diluting a concentrate up to 25 times. The concentrate contains a formaldehyde bisulfite precursor salt at from 200 to 600 g/l, sulfite ions at 0 to 200 g/l, a bleach accelerating agent at from 1.5 to 25 g/l, and a metal ion chelating agent present at up to 60 g/l. The concentrate is free of sodium ions.

13 Claims, No Drawings

PHOTOGRAPHIC REVERSAL PROCESS PREBLEACH CONCENTRATE

This is a Divisional of pending U.S. Ser. No. 08/670,307, filed Jun. 27, 1996, now allowed.

FIELD OF THE INVENTION

This invention relates in general to color photography and in particular to methods and compositions useful in the processing of color photographic materials, especially color reversal photographic elements. More particularly, this invention relates to an improved pre-bleach stabilizing concentrate, and its use in the processing of the noted materials.

BACKGROUND OF THE INVENTION

Multicolor, multilayer photographic elements are well known in the art. Such materials generally have three different selectively sensitized silver halide emulsion layers coated on one side of a single support. Each layer has components useful for forming a particular color in an image. Typically, they utilize color forming couplers that form yellow, magenta and cyan dyes in the sensitized layers during processing.

After color development, it is necessary to remove the silver image that is formed coincident with the dye image. This can be done by oxidizing the silver using a suitable oxidizing agent, commonly referred to as a bleaching agent, in the presence of a halide, followed by dissolving the silver halide so formed using what is known as a fixing agent. In some instances, the bleaching and fixing steps are combined into a single bleach-fixing step.

One commercially important process intended for use with color reversal photographic elements that contain color couplers in the emulsion layers, or layers contiguous thereto, uses the following sequence of processing steps: first developing, washing, reversal bath, color developing, bleaching, fixing, washing and stabilizing. Another useful process has the same steps, but stabilizing is carried out between color developing and bleaching.

In such photographic processes, a bleach-accelerator bath is often used between the color developing and bleaching steps. The bleach-accelerator bath is also known as a "conditioning" bath or solution. It is used to "condition" the metallic silver developed in the two developing steps, for complete oxidation to silver halide and to help preserve the acidity of the bleaching solution by reducing carryover of color developer into the bleaching solution. The conditioning solution contains, as an essential component, an effective amount of a bleach accelerating agent. This agent is imbibed into the emulsion layers of the photographic element during treatment with the conditioning bath, and is accordingly present to exert its intended effect when the element is put into the bleaching solution.

Magenta dye instability is a particularly undesirable problem in color photography, as the magenta dye image may fade more rapidly than either the cyan or yellow dye images. This is particularly evident when arylpyrazolone type magenta dye forming color couplers are used. Thus, considerable effort has been exerted to find solutions to this problem, including the use of dye stabilizers in stabilization baths at the end of the processing method, as described in U.S. Pat. No. 4,786,583 (Schwartz).

It is also known from U.S. Pat. No. 4,921,779 (Cullinan et al), U.S. Pat. No. 4,975,356 (Cullinan et al) and U.S. Pat. No. 5,037,725 (Cullinan et al) that formaldehyde precursors can be incorporated into conditioning solutions to further improve magenta dye stability. These patents describe a number of formaldehyde precursors for this purpose including sodium formaldehyde bisulfite, hexamethylenetetramine and various methylol compounds.

For some time, conditioning solutions for color reversal film processing have been used which contain relatively high concentrations of sodium formaldehyde bisulfite (for example, over 40 g/l and as much as 55 g/l). This effectively solves the magenta dye instability problem but there is a growing concern about the potential health hazards from exposure to formaldehyde during photofinishing. Various governmental regulations are requiring less exposure to formaldehyde.

U.S. Pat. No. 5,523,195 (Darmon et al) describes the use of a secondary amine in conditioning solutions to enable the amount of formaldehyde precursor to be reduced without compromising the effect of the solution to stabilize magenta dyes in color reversal materials.

Copending and commonly assigned U.S. Ser. No. 08/417,416, filed Apr. 5, 1995, by Cullinan et al, now U.S. Pat. No. 5,552,264 describes an improved conditioning or prebleach solution concentrate that includes a high level of sodium formaldehyde bisulfite as a formaldehyde precursor stabilizer. Such concentrated solutions also contains high amounts of sodium ion.

However, when the conditioning solution contains high sodium ion content, there is a propensity for the formation and subsequent precipitation of sodium ferric ethylenediaminetetraacetic acid in the subsequent bleaching bath. Ethylenediaminetetraacetic acid is a common bleaching agent ligand. Thus, carry-over from the conditioning solution brings undesirable sodium ions into the bleaching bath.

Thus, there is a further need to reduce the formation of precipitates in such processing, and to provide customers with an effective conditioning solution that provides both dye stability and bleach acceleration in a more concentrated form.

SUMMARY OF THE INVENTION

The problems noted above are solved with a conditioning solution concentrate that is free of sodium ions and comprises:

- a formaldehyde bisulfite salt other than the sodium salt, the salt being present in an amount of from about 200 to about 600 g/l,
- sulfite ions present in an amount of from 0 to about 200 g/l,
- a bleach accelerating agent present in an amount of from about 1.5 to about 25 g/l, and
- a metal ion chelating agent present in an amount of less than or equal to 60 g/l.

This invention also provides for a method for processing a color silver halide photographic element comprising:

A) treating an imagewise exposed and developed color silver halide photographic element with the conditioning solution concentrate described above that has been diluted up to 25:1 with water, and B) bleaching the treated element.

The present invention avoids the formation of precipitates of bleaching agents by using a conditioning or prebleach solution that is free of sodium ions. Moreover, the conditioning solution is packaged and shipped to customers in highly concentrated form. It was highly surprising that such a concentration of components (up to 25 times) could still be accomplished in the absence of sodium ions that are present in conventional conditioning solutions, both concentrated and diluted. Thus, the conventional sodium ions have been replaced with cations such as potassium or lithium ions which have much less propensity to form precipitates with conventional bleaching agents.

Detailed Description of the Invention

A wide variety of color reversal photographic elements can be used in the practice of the present invention. A detailed description of such materials is found, for example, in *Research Disclosure,* publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided herein below.

Color reversal photographic elements utilized in the practice of this invention are comprised of a support having on one side thereof a plurality of photosensitive silver halide emulsion layers. The photosensitive layers can contain any of the conventional silver halides as the photosensitive material, for example, silver chloride, silver bromide, silver bromoiodide, silver chlorobromide, silver chloroiodide, silver chlorobromoiodide, and mixtures thereof. Useful support materials include cellulose acetate film, polyvinylacetal film, polycarbonate film, polystyrene film, polyethylene terephthalate film, and the like. The silver halide is dispersed within a suitable hydrophilic colloid such as gelatin or derivatives thereof. The silver halide emulsion layers can contain a variety of well-known addenda, including but not limited to, chemical sensitizers, development modifiers and antifoggants.

As explained above, a well-known color reversal process of the prior art utilizes a first developer, a reversal bath, a color developer, a conditioning solution, a bleach bath, a fixing bath and a stabilizer bath. The components that are useful in each of such baths are well known in the photographic art. The improved process of this invention can utilize the same baths except that the stabilizer bath is not needed, that is, the final bath can be a rinse or wash bath consisting of water, or preferably an aqueous solution containing a sufficient amount of a surfactant to prevent spotting of the photographic film. In the present invention, the conditioning concentrate is diluted and used in a separate conditioning step, and is not used in conventional bleaching, fixing or bleach/fixing steps. Thus, the conditioning concentrate does not contain the compounds conventionally used as bleaching or fixing agents.

The first developer generally contains a black-and-white developing agent or a mixture thereof. Useful developing agents include, but are not limited to, dihydroxybenzene developing agents (such as hydroquinone), 3-pyrazolidone developing agents (such as 1-phenyl-3-pyrazolidone), and aminophenol developing agents (such as paraaminophenol). In addition to the developing agent, the first developer typically contains other agents such as preservatives, sequestering agents, restrainers, antifoggants, buffers and silver halide solvents.

The reversal bath generally contains a nucleating agent, such as a boron compound or a chelated stannous salt that functions as a reducing agent, as well as antioxidants, buffers, fungicides and sequestering agents.

In addition to an aromatic primary amino color developing agent, the color developing bath typically contains sequestering agents, buffering agents, preservatives, competing couplers and silver halide solvents.

Particularly useful aromatic primary amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include but are not limited to: N,N-diethyl-p-phenylenediamine monohydrochloride, 4-N,N-diethyl-2-methylphenylenediamine monohydrochloride, 4-(N-ethyl-N-2-methane-sulfonylaminoethyl)-2-methylphenylenediamine sesquisulfate monohydrate, 4-(N-ethyl-N-2-hydroxyethyl)-2-methyl-phenylenediamine sulfate, 4-N,N-diethyl-2,2'-methanesulfonylamino-ethylphenylenediamine hydrochloride, and others readily apparent to a skilled worker in the art.

The essential component of the bleaching bath is a bleaching agent that converts metallic silver to silver ions. Other common components of the bleaching bath include halides, sequestering agents and corrosion inhibitors. Ammonium or alkali metal salts of a ferric complex of an aminopolycarboxylic acid are particularly useful as bleaching agents but other metal complexes are known in the art, including binary and ternary complexes. Also of particular utility are the persulfate bleaching agents such as ammonium or alkali metal persulfates and peroxide bleaching agents. Bleaching agents can be used individually or in the form of mixtures of two or more bleaching agents.

The fixing bath converts all silver halide into soluble silver complexes that diffuse out of the emulsion layers. Fixing bath retained within the layers of the photographic element is removed in a subsequent water washing step. Thiosulfates, including ammonium thiosulfate and alkali metal thiosulfates (such as sodium thiosulfate and potassium thiosulfate), are particularly useful as fixing agents. Other components of the fixing bath include preservatives and sequestering agents.

A wide variety of different color reversal processes are well known in the art. For example, a single color developing step can be used when the coupling agents are incorporated in the photographic element or three separate color developing steps can be used in which coupling agents are included in the developing solutions. The reversal step can be carried out by use of a reversal bath, by a re-exposure step, or by incorporating a fogging agent in the color developing bath. In order to provide shorter processing times, bleaching and fixing can be combined in a single step (known as a bleach-fixing step).

The present invention is particularly concerned with enhancing dye stability through the use of a bleach-accelerating (or conditioning) solution that contains a bleach accelerating agent, a formaldehyde precursor, a sulfite and a metal ion chelating agent that is supplied in a highly concentrated form prior to use.

The conditioning solution concentrate of this invention is an aqueous acidic solution typically having a pH in the range of from about 4.5 to about 8.0. Preferably, the pH is from about 4.5 to about 6.5. The pH can be adjusted and maintained using one or more acids or buffers, as would be readily apparent to one skilled in the art.

The concentrate also contains one or more bleach accelerating agents that are generally present in an amount (total amount) of less than or equal to about 25 g/l of concentrate and more preferably in an amount of from about 1.5 to about 25 g/l of concentrate. More preferably, the amount is from about 1.5 to about 12 g/l. The working strength concentration of the bleach accelerating agent is, of course, much lower (up to 25 times less).

Sulfur-containing organic compounds are most commonly used as bleach-accelerating agents in conditioning solutions in photographic processing. However, other types of compounds are also known, including polyalkylene oxides, organic amines, onium compounds, and n-hexoxyethanol. More details of these and the commonly used sulfur-containing compounds are provided in U.S. Pat. No. 4,921,779 (noted above) which patent is incorporated herein by reference, and references cited therein. A mixture of bleach accelerating agents can be used if desired.

Preferred bleach accelerating agents include but are not limited to, heterocyclic thiols such as aminothiadiazolethiol, mercaptotriazole, imidazolethiol and aminomercaptotriazole, disulfides [such as bis(2-aminoethane)disulfide, thioglycerol disulfide and bis(N,N-dimethyl-2-aminoethane)-disulfide]and thioethers (such as dithiaoctanediol and thiadiethanol). Especially preferred are aliphatic thiols of the formula:

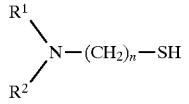

wherein each of $R^1$ and $R^2$ is H, methyl or ethyl and n is an integer having a value of from 1 to 3. Specific examples of such aliphatic thiols include 2-aminoethanethiol, 3-aminopropanethiol, dimethylaminoethanethiol, N-methyl-N-ethyl-amino-ethanethiol and diethylaminoethanethiol.

The most preferred bleach accelerating agent for the purpose of this invention is monothioglycerol.

Also included in the conditioning solution concentrate of this invention is a formaldehyde precursor.

By the term "formaldehyde precursor" is meant any compound capable of establishing, in the conditioning solution, an equilibrium relationship between it and formaldehyde. While not being certain of the mechanism, it is believed that the precursor acts, in effect, as a formaldehyde donor that gradually releases formaldehyde into the solution at the same rate as it is used up in the dye-stabilizing reaction to thereby maintain the equilibrium relationship. Thus, the concentration of formaldehyde in the bleach-accelerating solution is always at a very low level and there is not enough formaldehyde in the solution to result in a buildup or undesirably high concentrations in the air above the solution.

Formaldehyde precursors that are useful for the purpose of this invention include those that are free of added sodium ions. There may be insignificant amounts of sodium ions from the water used to make the solution, but no sodium ions are purposely added.

Particularly useful formaldehyde precursors include lithium formaldehyde bisulfite, potassium formaldehyde bisulfite and ammonium formaldehyde bisulfite.

The formaldehyde precursor can be added to the concentrate as a specifically added component, or it can be formed in situ by the reaction of formaldehyde and a bisulfite as one skilled in the art would readily understand.

The formaldehyde precursor is present in the concentrate in an amount of less than or equal to about 600 g/l of concentrate, with an amount of from about 200 to about 600 g/l being preferred, from about 500 to about 600 g/l being more preferred, and from about 550 to about 600 g/l being most preferred.

An optional (but preferred) material in the conditioning solution concentrate of this invention is a sulfite preservative (or a plurality thereof). It is present in an amount of from 0 to about 200 g/l of concentrate. Preferably, the sulfite is present in an amount of from 100 to about 200 g/l, and more preferably it is present at from about 100 to about 150 g/l.

Useful sulfites (and corresponding bisulfites and metabisulfites) are well known in the art and include, for example, potassium sulfite, lithium sulfite, potassium bisulfite, potassium metabisulfite, ammonium sulfite and corresponding bisulfites. Potassium sulfite and potassium metabisulfite, and mixtures thereof are preferred. There is no sodium ion added with a sulfite or bisulfite in this invention.

Also included in the concentrate of this invention is one or more metal ion chelating agents, such as chelating agents for iron, calcium, magnesium, manganese, copper and other metals commonly found in processing solutions. Preferably, chelating agents for iron ions (such as ferric ion) are used. Useful chelating agents are well known in the art, and include for example, ethylenediaminetetraacetic acid, ethylenediaminepentaacetic acid, and other polydentate carboxylic acids, aminocarboxylic acids and phosphonic acids that are generally known for photographic bleaching solutions. The first compound is preferred, but one skilled in the art should understand that there are many useful chelating agents of various composition, molecular weight and effectiveness.

One or more of these chelating agents are present in a total amount of up to about 60 g/l, with amounts in the range of from about 10 to about 60 g/l being preferred.

An optional component of the concentrate of this invention is a secondary amine compound such as those described in U.S. Pat. No. 5,523,195, identified above. Such compounds have at least one secondary amine moiety, and may have up to 3 of such groups in the molecule. The secondary amines can be linear or cyclic, as described in the noted application. Preferably, the secondary amines are either dialcoholamines or 6-membered heterocyclic rings having at least one secondary amine moiety in the ring. Representative secondary amines include, but are not limited to, diethanolamine, diisopropanolamine, N-methyl-N-ethylamine, N-hydroxyethyl-N-benzylamine, N-methyl-N-phenylamine, N,N-bis(hydroxyethyl)amine, pyrrolidine, imidazole, 1,4-dihydropyridine, 3-pyrroline, morpholine, piperidine and piperazine. Of these, diethanolamine, morpholine and piperidine are most preferred.

The amount of secondary amine useful in the concentrate is generally at least about 0.75 g/l, with from about 1.5 to about 25 g/l being preferred.

The conditioning solution concentrate of this invention can also include various addenda commonly included in such solutions, as described in the art cited above, including, but not limited to, anti-scumming agents, surfactants, biocides, metal sequestrants, buffers and antioxidants.

The concentrate of this invention can be supplied in any suitable container made of glass, synthetic polymers, metal or various known metal/polymer composites, but preferably, those containers are prepared from synthetic polymers such as high and low density polyethylene, polyvinylidene chloride, various polyamides (such as nylon) or any other material that is inert to the concentrate of this invention. A container can be as small as a single-use packet, vial or bottle, or it can be much larger. Thus, a suitable container can be prepared to hold any suitable volume of concentrate.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerably more details of the element structure and components, and suitable methods of processing various types of elements are described in *Research Disclosure,* noted above. All types of emulsions can be used in the elements, including but not limited to, thin tabular grain emulsions, and either positive-working or negative-working emulsions.

The present invention is particularly useful for processing imagewise exposed and developed photographic elements containing arylpyrazolone type magenta dye forming color couplers. Such color couplers are well known in the art. One such compound is described in U.S. Pat. No. 5,037,725 (noted above).

The elements are typically exposed to suitable radiation to form a latent image and then processed as described above to form a visible dye image.

The concentrate of this invention is generally supplied to the processing equipment after dilution with water of up to 25:1 (preferably from 18:1 to 21:1 and more preferably, 19:1). Alternatively, the concentrate can be diluted as it is being used.

The conditioning step described above is generally carried out for less than 5 minutes, but longer times can be used if desired. Preferably, the conditioning time is from about 0.5 to about 2 minutes. The temperature at which the conditioning step is carried out is generally at or above room temperature, for example from about 20° to about 40° C.

Processing according to the present invention can be carried out using conventional deep tanks holding processing solutions. Alternatively, it can be carried out using what is known in the art as "low volume thin tank" processing systems having either rack and tank or automatic tray designs. Such processing methods and equipment are described, for example, in U.S. Pat. No. 5,436,118 and publications noted therein.

The following examples are provided for illustrative purposes only and are not intended to be limiting in any way. Unless otherwise indicated, all percentages are by weight.

EXAMPLE 1

Preferred Conditioning Solution Concentrate

A preferred conditioning solution concentrate of this invention was prepared by mixing the following in water (322.5 g), in order: formaldehyde (37%, 298.6 g), potassium metabisulfite (392.4 g), potassium sulfite (45%, 297 g), thioglycerol (90%, 10.36 g), ethylenediaminetetraacetic acid (60 g), and phosphoric acid (75%, 26.6 g). Potassium formaldehyde bisulfite is formed in situ.

This working strength solution was concentrated 19:1.

EXAMPLES 2–3

Alternative Conditioning Solution Concentrates

Two conditioning solutions were prepared by mixing the following components in water (up to 1 liter):

EXAMPLE 2

Water (50 g), formaldehyde (37%, 150.3 g), potassium sulfite (45%, 792.7 g), thioglycerol (90%, 5.18 g), ethylenediaminetetraacetic acid (30 g), phosphoric acid (75%, 13.3 g), and hydrobromic acid (48%, 284.0 g). This solution (pH of 5.95) was concentrated 10 times to provide a concentrate solution of this invention.

EXAMPLE 3

Water (399.9 g), formaldehyde (37%, 298.6 g), potassium metabisulfite (501.8 g), thioglycerol (90%, 10.36 g), ethylenediaminetetraacetic acid (60.0 g), phosphoric acid (75%, 26.6 g) and potassium hydroxide (45%, 100.8 g). The final pH was 5.95, and the solution was concentrated 20 times to provide a solution concentrate of this invention.

EXAMPLE 4

Use of Conditioner Concentrate Solution

The concentrate of this invention was diluted conditioning solution prepared in Example 1 was evaluated by using it to process samples of a conventional color reversal photographic film (Film Code 6121) using the following processing protocol. This film contained a conventional 1-aryl-5-pyrazolone magenta color coupler in one of the emulsion layers.

| Processing Protocol: | |
|---|---|
| 6 minutes | First Development* |
| 2 minutes | Water wash |
| 2 minutes | Reversal bath** |
| 6 minutes | Color development*** |
| 2 minutes | Conditioning |
| 6 minutes | Bleaching**** |
| 4 minutes | Fixing# |
| 4 minutes | Water wash |
| 30 seconds | Final wash## |
| 20 minutes | Drying |

*Development using conventional KODAK First Developer for Process E-6.
**Reversal bath was conventional KODAK Reversal Bath, Process E-6.
***Color developing using conventional KODAK Color Developer, Process E-6.
**** Bleaching using conventional KODAK Bleach, Process E-6.
#Fixing using conventional KODAK Fixer, Process E-6.
Final washing using KODAK Final Rinse, Process E-6.

After the film samples were processed, they were evaluated by liquid chromatography to determine residual magenta color coupler in the element, and also in an accelerated keeping test (at 77° C. and 0% relative humidity) to determine the amount of magenta dye fade. The concentrate of this invention, when appropriately diluted, performed acceptably as a conditional solution in the processing of these reversal elements.

The invention has been described in detail with particular reference to preferred embodiments thereof, but it will be understood that variations and modifications can be effected within the spirit and scope of the invention.

We claim:

1. A conditioning solution concentrate that is free of sodium ions and comprises:

a formaldehyde bisulfite salt other than the sodium salt, said salt being present in an amount of from about 200 to about 600 g/l, sulfite ions present in an amount of from 0 to about 200 g/l, a bleach accelerating agent present in an amount of from about 1.5 to about 25 g/l, and a metal ion chelating agent present in an amount of less than or equal to 60 g/l.

2. The solution concentrate of claim 1 wherein said bleach accelerating agent is a sulfur-containing organic compound.

3. The solution concentrate of claim 2 wherein said bleach accelerating agent is an aliphatic thiol.

4. The solution concentrate of claim 1 wherein said formaldehyde bisulfite salt is lithium formaldehyde bisulfite or potassium formaldehyde bisulfite.

5. The solution concentrate of claim 4 wherein said formaldehyde bisulfite salt is potassium formaldehyde bisulfite.

6. The solution concentrate of claim 1 wherein said sulfite is potassium sulfite, potassium metabisulfite or a mixture thereof.

7. The solution concentrate of claim 1 having a pH of from about 4.5 to about 8.0.

8. The solution concentrate of claim 1 wherein said formaldehyde bisulfite salt is present in an amount of from about 500 to about 600 g/l, said sulfite is present in an amount of from about 100 to about 200 g/l, said bleach accelerator agent is present in an amount of from about 1.5 to about 12 g/l, and said metal ion chelating agent is present in an amount of from about 10 to about 60 g/l.

9. The solution concentrate of claim 8 wherein said formaldehyde bisulfite salt is present in an amount of from about 550 to about 600 g/l, and the pH is from about 4.5 to about 6.5.

10. A conditioning solution provided by diluting the concentrate of claim 1 up to 25:1 with water.

11. The solution concentrate of claim 1 wherein said metal ion chelating agent is a metal chelate of a polydentate carboxylic acid, aminocarboxylic acid or phosphonic acid.

12. The solution concentrate of claim 11 wherein said metal ion chelating agent is a metal chelate of ethylenediaminetetraacetic acid or ethylenediaminepentaacetic acid.

13. The solution concentrate of claim 12 wherein said metal ion chelating agent is a metal chelate of ethylenediaminetetraacetic acid.

* * * * *